US011480895B2

(12) United States Patent
Nakajima

(10) Patent No.: US 11,480,895 B2
(45) Date of Patent: Oct. 25, 2022

(54) IMAGE FORMING APPARATUS TO ADDRESS INTERMEDIATE TRANSFER BELT REPLACEMENT

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/357,783

(22) Filed: Jun. 24, 2021

(65) Prior Publication Data

US 2022/0011696 A1 Jan. 13, 2022

(30) Foreign Application Priority Data

Jul. 7, 2020 (JP) ..... JP2020-117361

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615; G03G 21/168
USPC ..... 399/121, 302
See application file for complete search history.

(56) References Cited

U.S. PATENT DOCUMENTS 9,261,823 B2 * 2/2016 Hatano ..... G03G 15/1615
10,947,072 B2 * 3/2021 Nakajima ..... G03G 15/1615

FOREIGN PATENT DOCUMENTS

JP 2004138945 A 5/2004
JP 2018169606 A 11/2018
JP 2019020604 A 2/2019

* cited by examiner

*Primary Examiner* — William J Royer
(74) *Attorney, Agent, or Firm* — Canon U.S.A., Inc. I.P. Division

(57) ABSTRACT

An image forming apparatus includes an image bearing member, an image forming unit, a belt conveying device including an intermediate transfer belt, a pair of restriction portions provided in the belt conveying device, and restriction engagement portions. The image forming unit forms a toner image on the image bearing member and the toner image is transferred to the intermediate transfer belt. The pair of restriction portions and the restriction engagement portions cooperate to restrict an orientation of the intermediate transfer belt. One restriction portion of the pair of restriction portions is supported to be movable to a first position where at least a part of the one restriction portion is placed outside a stretching area defined by the intermediate transfer belt in a stretched state, and a second position where the one restriction portion is inside the stretching area as viewed from a width direction of the intermediate transfer belt.

16 Claims, 12 Drawing Sheets

IMAGE FORMING APPARATUS TO ADDRESS INTERMEDIATE TRANSFER BELT REPLACEMENT

BACKGROUND

Field

The present disclosure relates to an image forming apparatus including a belt conveying device that conveys and drives an intermediate transfer belt stretched around a plurality of stretching rollers.

Description of the Related Art

An electrophotographic image forming apparatus is known having a configuration of an intermediate transfer method for primarily transferring a toner image formed on a photosensitive member to a surface of an intermediate transfer belt and further secondarily transferring the toner image borne on the intermediate transfer belt to a recording medium.

In such an image forming apparatus using an intermediate transfer belt method, an image defect may occur due to a fluctuation in the resistance value or the deterioration of the surface caused by the continuous use of the intermediate transfer belt. It is therefore necessary to replace the intermediate transfer belt with a new intermediate transfer belt to maintain desired image quality when the intermediate transfer belt reaches a predetermined end of life.

For such a purpose, the intermediate transfer belt is replaced by pulling out a belt conveying device along guide rails provided in the image forming apparatus. In the belt conveying device, positioning members that position the belt conveying device are provided in both end portions in a width direction of the intermediate transfer belt. These positioning members are provided such that a pair of the positioning members is provided on each of the upstream and downstream sides in the insertion direction of the belt conveying device. The belt conveying device can then be pulled out by pulling out these positioning members along the guide rails. In such a belt conveying device, it is likely that, when the belt conveying device is attached to and detached from the image forming apparatus, the orientation of the belt conveying device changes and the intermediate transfer belt comes into contact with peripheral members and becomes damaged. To prevent the situation, it is desirable to provide the belt conveying device with a restriction member that restricts the orientation of the belt conveying device.

Japanese Patent Application Laid-Open No. 2018-169606 discusses a configuration where guide ribs are provided upstream and downstream in the attachment direction of a belt conveying device. The guide ribs downstream in the attachment direction of the belt conveying device further restrict the orientation of the belt conveying device. The guide ribs are guided using guide rails placed one above the other.

The belt conveying device as discussed in Japanese Patent Application Laid-Open No. 2018-169606 is, however, likely to become large in the up-down direction in a case of a configuration in which positioning members of a belt conveying device and a restriction member that restricts the orientation of the belt conveying device are pulled out using guide rails placed one above the other.

To ease the intermediate transfer belt replacement, the frame of the belt conveying device is placed within a cross section around which the intermediate transfer belt is stretched (hereinafter also referred to as a "belt-stretched cross section") as viewed from the width direction of the intermediate transfer belt. This is to prevent the intermediate transfer belt from interfering with the main body frame of the belt conveying device when the intermediate transfer belt is pulled out in the width direction of the intermediate transfer belt when the intermediate transfer belt is replaced. The restriction member is thus often placed within the belt-stretched cross section. In a case where the belt conveying device is downsized in its height direction, however, the restriction member may not be included within the belt-stretched cross section. It is therefore difficult to achieve both the downsizing and the ease of intermediate transfer belt replacement.

SUMMARY

The present disclosure is directed to providing an image forming apparatus including a belt conveying device attachable to and detachable from the image forming apparatus, and capable of achieving both downsizing of the apparatus and an improvement in the ease of intermediate transfer belt replacement while preventing an intermediate transfer belt from being damaged when the belt conveying device is attached to and detached from the image forming apparatus.

According to an aspect of the present disclosure, an image forming apparatus includes an image bearing member configured to bear a toner image, an image forming unit configured to form the toner image on the image bearing member, a belt conveying device including an intermediate transfer belt to which the toner image formed on the image bearing member is to be transferred, wherein the belt conveying device is provided to be attachable to and detachable from the image forming apparatus in a direction intersecting a width direction of the intermediate transfer belt orthogonal to a moving direction of the intermediate transfer belt and intersecting a vertical direction, a pair of restriction portions provided in the belt conveying device and configured to restrict an orientation of the intermediate transfer belt, and restriction engagement portions provided in a main body of the image forming apparatus and configured to restrict the orientation of the intermediate transfer belt by being engaged with the pair of restriction portions at least in a case where the belt conveying device is pulled out to a predetermined position in the image forming apparatus, wherein one restriction portion of the pair of restriction portions is supported to be movable to a first position where at least a part of the one restriction portion is placed outside a stretching area defined by the intermediate transfer belt in a stretched state, as viewed from the width direction of the intermediate transfer belt, and a second position where the one restriction portion is inside the stretching area as viewed from the width direction of the intermediate transfer belt.

Further features of the present disclosure will become apparent from the following description of exemplary embodiments with reference to the attached drawings.

DESCRIPTION OF THE EMBODIMENTS

A belt conveying device and an image forming apparatus according to the present disclosure will now be described with reference to the drawings.

Figure 1:
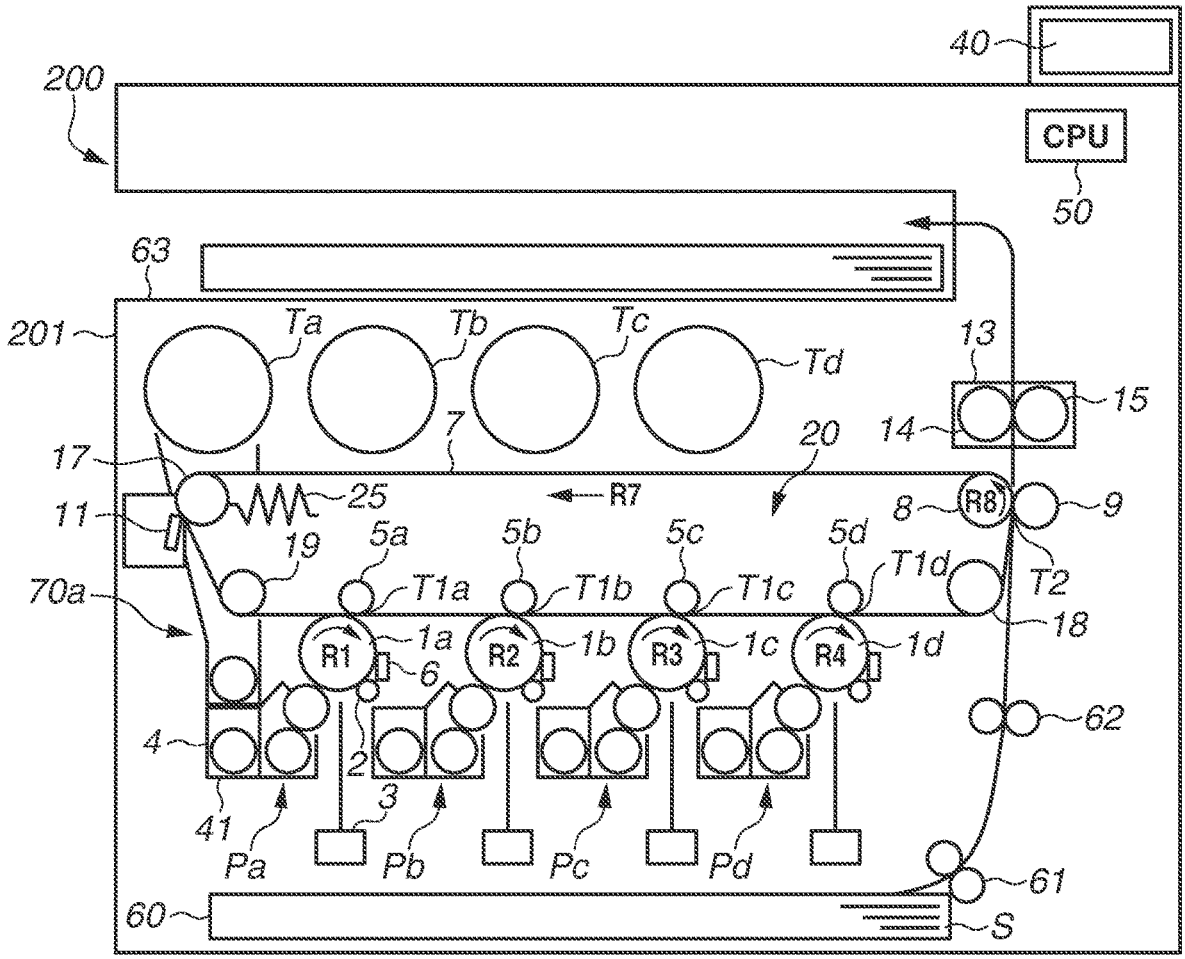
FIG. 1 is a schematic diagram illustrating a configuration of an image forming apparatus according to the present disclosure.

An image forming apparatus 200 according to a first exemplary embodiment is a so-called intermediate transfer tandem printer including four image forming units Pa, Pb, Pc, and Pd and an intermediate transfer unit 20 within an apparatus main body 201 as illustrated in FIG. 1. The image forming apparatus 200 forms an image on a printing medium S and outputs the printing medium S. Examples of the printing medium S include plain paper, special paper such as coated paper, printing media having special shapes, such as an envelope and index paper, overhead projector plastic film, and cloth.

The image forming units Pa, Pb, Pc, and Pd are image forming units that form yellow, magenta, cyan, and black toner images and include photosensitive drums 1*a*, 1*b*, 1*c*, and 1*d*, respectively, as image bearing members for electrophotography. The configurations of the image forming units Pa, Pb, Pc, and Pd are basically similar to each other except for the color of toner for use in development, and therefore are described below using the configuration of the yellow image forming unit Pa as an example.

The image forming unit Pa includes a charging device 2, an exposure device 3, a developing device 4, and a drum cleaner 6 around the photosensitive drum 1*a*, which is a drum-like photosensitive member. When an image forming operation starts, the photosensitive drum 1*a* is driven to rotate, and the surface of the photosensitive drum 1*a* is uniformly charged by the charging device 2. An electrostatic latent image is then formed on the surface of the photosensitive drum 1*a* by the exposure device 3. Yellow toner is supplied to the photosensitive drum 1*a* from the developing device 4 that stores a developer within a developing container 41, thereby visualizing (developing) the electrostatic latent image formed on the photosensitive drum 1*a* into a toner image. In other words, the charging device 2, the exposure device 3, and the developing device 4 form a toner image forming method for forming a toner image on the photosensitive drum 1*a* as one of the image bearing members.

Developer storage containers Ta, Tb, Tc, and Td that store developer to be resupplied are detachably attached to the apparatus main body 201. For example, the developer storage container Ta stores developer containing yellow toner, which is appropriately resupplied to the developing container 41 via a resupply device 70*a*. Examples of the developer include two-component developer containing magnetic carrier and nonmagnetic toner, monocomponent developer composed of magnetic toner, and liquid developer obtained by dispersing toner particles in carrier liquid.

The intermediate transfer unit 20 includes an intermediate transfer belt 7, which is an endless belt member, and a plurality of roller members (rollers 8, 17, 18, and 19) around which the intermediate transfer belt 7 is stretched. Specifically, the intermediate transfer belt 7 is wound around a secondary inner transfer roller 8, a steering roller 17, a separation roller 19, and an upstream guide roller 18. The intermediate transfer belt 7 is opposed to the photosensitive drums 1*a* to 1*d* of the image forming units Pa to Pd on the outer peripheral surface of the intermediate transfer belt 7. On the inner peripheral side of the intermediate transfer belt 7, primary transfer rollers 5*a*, 5*b*, 5*c*, and 5*d* are placed, which are examples of primary transfer methods. The primary transfer rollers 5*a* to 5*d* are placed at positions corresponding to the photosensitive drums 1*a* to 1*d* of the image forming units Pa to Pd, thereby forming primary transfer units T1*a*, T1*b*, T1*c*, and T1*d* that transfer toner images from the photosensitive drums 1*a* to 1*d*, respectively, to the intermediate transfer belt 7.

The secondary inner transfer roller 8 is driven to rotate in a predetermined direction (an arrow R8) by a motor (not illustrated), whereby the intermediate transfer belt 7 rotates in the direction (an arrow R7) in which the intermediate transfer belt 7 rotates along with the rotation (arrows R1, R2, R3, and R4) of the photosensitive drums 1*a* to 1*d* of the image forming units Pa to Pd, respectively. That is, the secondary inner transfer roller 8 is a driving roller that drives the intermediate transfer belt 7. The secondary inner transfer roller 8 is opposed to a secondary outer transfer roller 9 through the intermediate transfer belt 7. A secondary transfer unit T2 is formed as a nip portion between the secondary inner transfer roller 8 and the secondary outer transfer roller 9.

The upstream guide roller 18 is placed upstream of the secondary inner transfer roller 8 and downstream of the primary transfer rollers 5*a* to 5*d* in the rotational direction of the intermediate transfer belt 7. The upstream guide roller 18 guides the intermediate transfer belt 7 into the secondary transfer unit T2 from a certain direction. As will be described in detail below, the steering roller 17 has a center adjustment function for controlling the position in the width direction of the intermediate transfer belt 7. The separation roller 19 is placed downstream of the steering roller 17 and upstream of the primary transfer rollers 5*a* to 5*d* in the rotational direction of the intermediate transfer belt 7. The primary transfer rollers 5*a* to 5*d* and the separation roller 19 move by a below-described separation mechanism 30A (FIG. 2B). and thereby can change the stretched form of the intermediate transfer belt 7 and separate the outer peripheral surface of the intermediate transfer belt 7 from some or all of the photosensitive drums 1*a* to 1*d*.

Toner images formed on the photosensitive drums 1*a* to 1*d* at the image forming units Pa to Pd by an image forming operation similar to the above are primarily transferred to the intermediate transfer belt 7 at the primary transfer units T1*a* to T1*d* by electrostatic biases applied to the primary transfer rollers 5*a* to 5*d*, respectively. In a case where a color image is formed at this time, the toner images are subjected to multiple transfer such that the toner images borne on the photosensitive drums 1*a* to 1*d* are superimposed on each other. After the intermediate transfer belt 7 passes through the primary transfer units T1*a* to T1*d*, attached objects such as transfer residual toner remaining on the photosensitive drums 1*a* to 1*d* are removed by the drum cleaners 6.

The toner image borne on the intermediate transfer belt 7 is secondarily transferred to the printing medium S at the secondary transfer unit T2 by applying an electrostatic bias to the secondary outer transfer roller 9. After the intermediate transfer belt 7 passes through the secondary transfer unit T2, attached objects such as transfer residual toner remaining on the intermediate transfer belt 7 are removed by a belt cleaning device 11.

In parallel with such an image forming operation, the printing medium S set in a feed cassette 60 is fed to a registration roller pair 62 by a feed unit 61 such as feed rollers. The registration roller pair 62 corrects the skew of the printing medium S and also sends the printing medium S into the secondary transfer unit T2 in time with the progress of the image forming operation by the image forming units Pa, Pb, Pc, and Pd.

The printing medium S to which an unfixed toner image has been transferred at the secondary transfer unit T2 is delivered to a fixing device 13. The fixing device 13 includes a heating roller 14 that is heated by a heat source, such as a halogen heater, and an opposing roller 15 that is in pressure contact with the heating roller 14. The fixing device 13 applies heat and pressure to the toner image while nipping and conveying the printing medium S. The toner particles are then fused and firmly fixed, and thereby the image is fixed to the printing medium S. After passing through the fixing device 13, the printing medium S is discharged to a discharge tray 63 provided above the apparatus main body 201. In a case where two-sided printing is performed, the printing medium S is conveyed again to the registration roller pair 62 in the state where a first surface (a front surface) and a second surface (a back surface) of the printing medium S are reversed via a reverse conveying path (not illustrated). After passing through the secondary transfer unit T2 and the fixing device 13, the printing medium S is discharged to the discharge tray 63 in the state where an image is formed on the back surface of the printing medium S.

On the upper surface of the apparatus main body 201, an operation display unit 40 as a user interface is provided. The operation display unit 40 includes a liquid crystal panel capable of displaying the current setting information, and various buttons for allowing a user to input information. The user can thereby set for, for example, switching an output image between a color image and a monochrome image. The apparatus main body 201 is provided with a central processing unit (CPU) 50 that performs overall control of the operation of the image forming apparatus 200 based on information input through the operation display unit 40.

[Intermediate Transfer Unit]

Figure 2A:
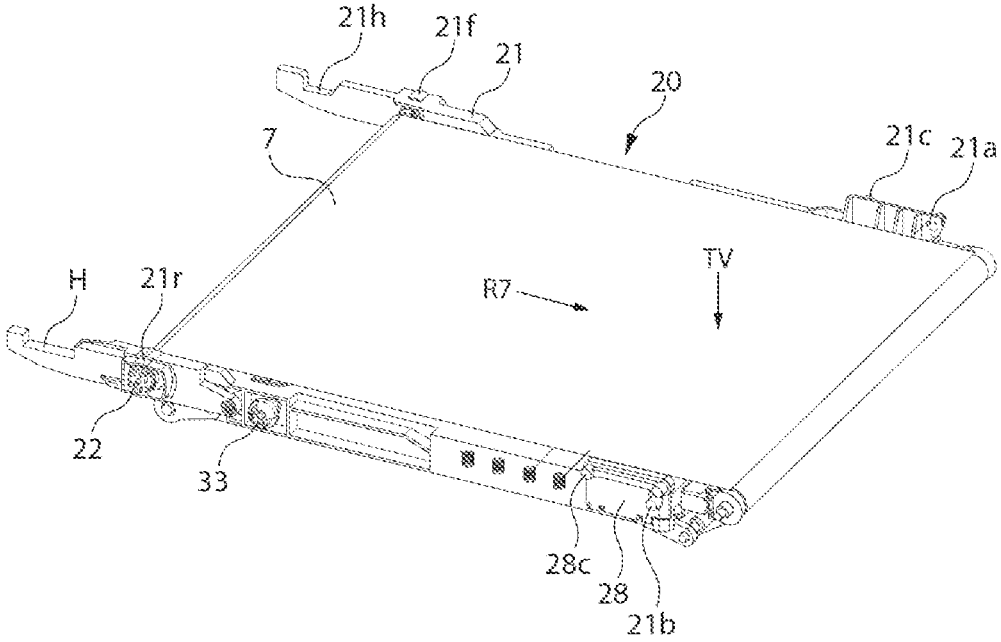
FIG. 2A is a perspective view of an intermediate transfer unit.
Figure 2B:
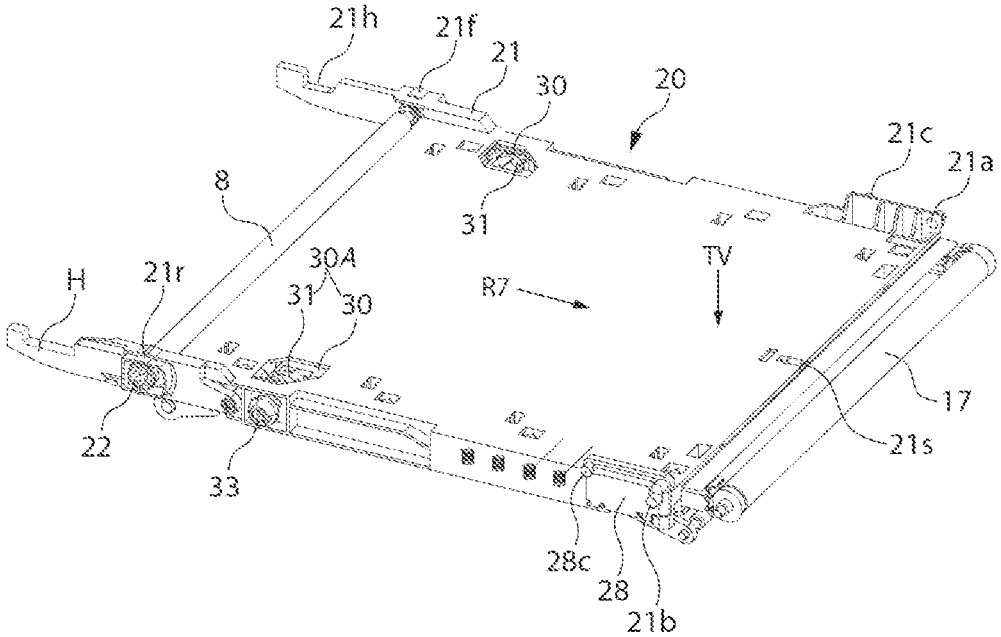
FIG. 2B is a perspective view of the intermediate transfer unit from which an intermediate transfer belt is detached.

A description will now be given of the internal configuration of the intermediate transfer unit 20, which is an example of the belt conveying device, and the configuration for steering the intermediate transfer belt 7. FIGS. 2A and 2B are perspective views of the intermediate transfer unit 20. FIG. 2A illustrates the state where the intermediate transfer belt 7 is stretched. FIG. 2B illustrates the state where the intermediate transfer belt 7 is detached.

As illustrated in FIGS. 2A and 2B, the intermediate transfer unit 20 includes a transfer frame 21 supported by transfer rails 78F and 78R described below as guide members. The transfer frame 21 is provided with first positioning portions 21*f* and 21*r* and second positioning portions 21*a* and 21*b* for attaching the intermediate transfer unit 20 to the transfer rails 78F and 78R. The first positioning portions 21*f* and 21*r* and the second positioning portions 21*a* and 21*b* are formed integrally with the transfer frame 21. The first positioning portions 21*f* and 21*r* are fixed to the transfer frame 21 such that the first positioning portions 21*f* and 21*r* and the second positioning portions 21*a* and 21*b* cannot move relative to the transfer frame 21. In an attached state of the intermediate transfer unit 20, the first positioning portions 21*f* and 21*r* are placed symmetrically with each other and formed coaxially with the secondary inner transfer roller 8. The first positioning portions 21*f* and 21*r* are placed outside a drive coupling 22 in the radial direction of the secondary inner transfer roller 8. The first positioning portions 21*f* and 21*r* are placed around the drive coupling 22 as viewed from the axial direction of the secondary inner transfer roller 8. The second positioning portions 21*a* and 21*b* are also placed symmetrically (coaxially) with each other. The intermediate transfer unit 20 is attached to the apparatus main body 201 by four positioning portions that include the second positioning portions 21*a* and 21*b* and the first positioning portions 21*f* and 21*r*, thereby forming a cross section of the image forming apparatus 200 illustrated in FIG. 1. Since a configuration is employed in which the first positioning portions 21*f* and 21*r* are placed outside the drive coupling 22 in the radial direction of the secondary inner transfer roller 8 in the present exemplary embodiment, the up-down width of each of the first positioning portions 21*f* and 21*r* is configured to be greater than the up-down width of each of the second positioning portions 21*a* and 21*b*. The transfer frame 21 and a positioning plate 28 are provided with third positioning portions 21*c* and 28*c* symmetrically with each other. The functions of the third positioning portions 21*c* and 28*c* will be described below.

Both ends in the axial direction of each of the secondary inner transfer roller 8, the upstream guide roller 18, and the separation roller 19 are rotatably and axially supported by the transfer frame 21 such that the rollers 8, 18, and 19 are sandwiched. The axial directions of the rollers 8, 18, and 19 are defined as a width direction W of the intermediate transfer belt 7. An automatic belt alignment mechanism 17U including the steering roller 17 is supported by a steering supporting portion 21*s* provided in the transfer frame 21.

The drive coupling 22 is attached to one end portion in the axial direction of the secondary inner transfer roller 8. In the state where the intermediate transfer unit 20 is attached to the apparatus main body 201, the drive coupling 22 is linked to an output shaft of a belt driving unit (not illustrated) and transmits the driving force of the belt driving unit to the secondary inner transfer roller 8. The belt driving unit provided in the apparatus main body 201 includes a driving source such as a motor, and a coupling member to be engaged with the drive coupling 22. The surface of the secondary inner transfer roller 8 is formed of a material having a relatively high coefficient of friction, such as rubber, so that the driving force is transmitted to the secondary inner transfer roller 8, whereby the surface of the roller conveys and drives the intermediate transfer belt 7 in the direction of the arrow R7 illustrated in FIG. 2A. In the present exemplary embodiment, the drive coupling 22 is used as a drive transmission method. Alternatively, a driving source of the apparatus main body 201 and the intermediate transfer unit 20 may be linked together using, for example, gears capable of coming into contact with and separating from each other.

As described above, the present exemplary embodiment is provided with an automatic belt alignment mechanism 17U for the intermediate transfer belt 7 that is driven and conveyed. The automatic belt alignment mechanism 17U can make a belt center adjustment (steer) of the intermediate transfer belt 7, i.e., control the position in the width direction W of the intermediate transfer belt 7, by the steering roller 17 maintaining the balance between the frictional forces of both end portions of the intermediate transfer belt 7.

Figure 3:
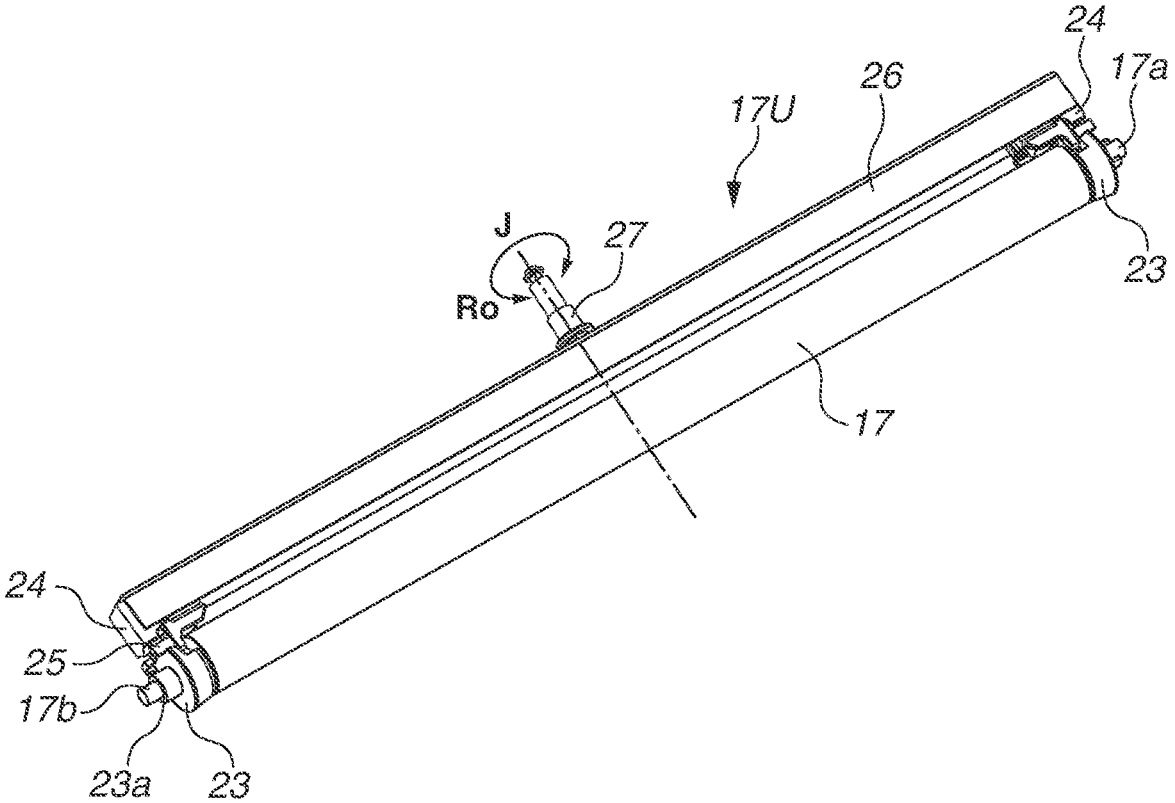
FIG. 3 is a perspective view of an automatic belt alignment mechanism.
Figure 4:
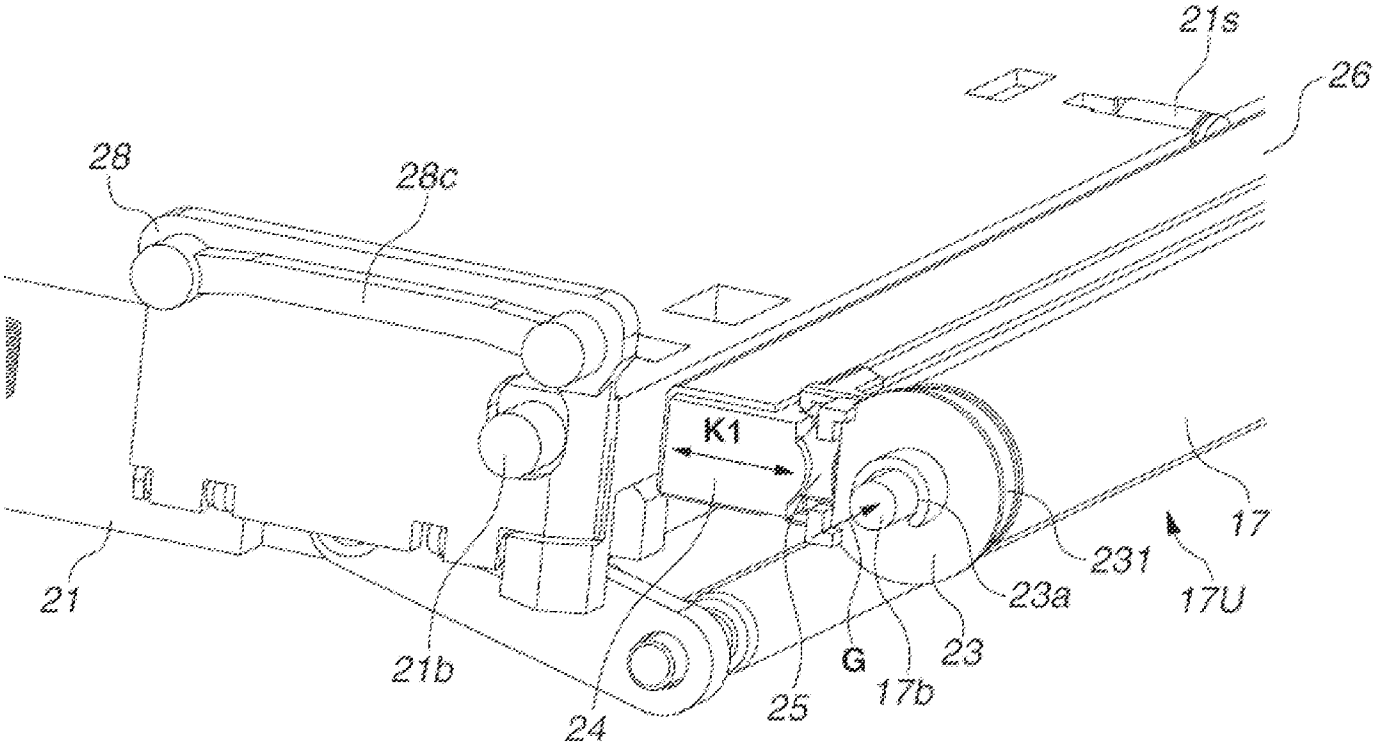
FIG. 4 is an enlarged view of an end portion of the automatic belt alignment mechanism.

A description will be given below of the configuration of an automatic belt alignment mechanism 17U, which is an example of a steering mechanism, with reference to FIGS. 3 and 4. FIG. 3 is a perspective view illustrating the automatic belt alignment mechanism 17U. FIG. 4 is an enlarged perspective view of an end portion of the automatic belt alignment mechanism 17U.

As illustrated in FIG. 3, the steering roller 17 includes a cylindrical roller main body 17*a* and roller shafts 17*b* protruding from the roller main body 17*a* on both sides in the axial direction of the steering roller 17. At positions opposed to both end portions in the axial direction of the steering roller 17, respective steering bearings 23 are placed. Each roller shaft 17*b* is rotatably and axially supported by the steering bearing 23 in the state where the roller shaft 17*b* is inserted in a fitting manner through a supporting hole 23*a* provided in the steering bearing 23.

The pair of steering bearings 23 is attached to a swinging plate 26 in the state where the steering bearings 23 support both end portions in the axial direction of the steering roller 17, which is one of a plurality of stretching rollers around which the intermediate transfer belt 7 is stretched. The steering bearings 23 are slidably supported by slide guides 24 attached to both end portions of the swinging plate 26. Between the steering bearings 23 and the slide guides 24, tension springs 25 that are compression springs are provided in contracted states.

The swinging plate 26 is an example of a swinging member that swings the steering roller 17, thereby supporting the steering roller 17 in the state where the relative alignment of the steering roller 17 with the secondary inner transfer roller 8 can be changed. The tension springs 25 are examples of biasing members that apply tension to act on the inner periphery of the intermediate transfer belt 7 to the steering roller 17. That is, the tension springs 25 as the biasing members according to the present exemplary embodiment are composed of a pair of spring members that applies biasing forces to the pair of steering bearings 23 at both end portions of the swinging plate 26.

As illustrated in FIGS. 3 and 4, the slide guides 24 include fitting grooves that guide the steering bearings 23 to move along the pressurization directions of the tension springs 25 (the direction of an arrow K1 in FIG. 4). In other words, the slide guides 24 form guide portions that guide the pair of steering bearings 23 in the biasing directions of the tension springs 25. The slide guides 24 also include stoppers (not illustrated) capable of restricting the movement of the steering bearings 23 in the pressurization directions of the tension springs 25. The stoppers prevent the steering bearings 23 and the steering roller 17 from coming off in an assembly state where the automatic belt alignment mechanism 17U is not attached to the intermediate transfer unit 20. With these components, it is possible to effectively transmit the biasing forces of the tension springs 25 in both end portions to the respective steering bearings 23.

In the state where the intermediate transfer belt 7 is stretched around the steering roller 17 and the other roller members 8, 18, and 19 as illustrated in FIG. 2A, the steering bearings 23 move in the direction in which the steering bearings 23 compress the tension springs 25 more than at the positions where the movement of the steering bearings 23 is restricted by the stoppers. In this state, the steering roller 17 is pressed against the inner peripheral surface of the intermediate transfer belt 7 by the elastic forces of the tension springs 25, and tension occurs in the intermediate transfer belt 7, accordingly. In other words, the steering roller 17 according to the present exemplary embodiment doubles as a tension roller that applies appropriate tension to the intermediate transfer belt 7 by biasing forces from the tension springs 25.

As illustrated in FIG. 3, a pivotal shaft member 27 as a supporting shaft is fixed to a center portion in the width direction W of the swinging plate 26 as the swinging member, in the state where the pivotal shaft member 27 protrudes backwards in FIG. 3. The slide guides 24 are also fixed to both end portions of the swinging plate 26. The pivotal shaft member 27 is fitted in a pivotable state to the steering supporting portion 21*s* provided in the transfer frame 21, thereby rotatably (swingably) supporting the swinging plate 26.

The swinging plate 26 can thereby swing in a swinging direction Ro about a steering axis J, which is the axis of the pivotal shaft member 27, in the state where the swinging plate 26 supports the steering roller 17. That is, the automatic belt alignment mechanism 17U, which is an example of an alignment change method for changing the alignment of the intermediate transfer belt 7, is configured as a unit capable of swinging together with the steering roller 17 relative to the frame body of the intermediate transfer unit 20.

[Operating Principle of Automatic Belt Alignment Mechanism]

Figure 5A:
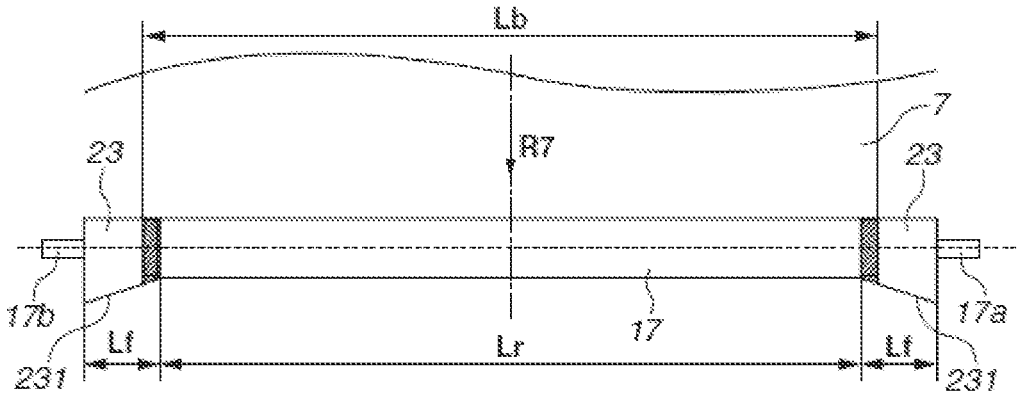
FIG. 5A is a schematic diagram illustrating an operating principle of the automatic belt alignment mechanism in a steady state.
Figure 5B:
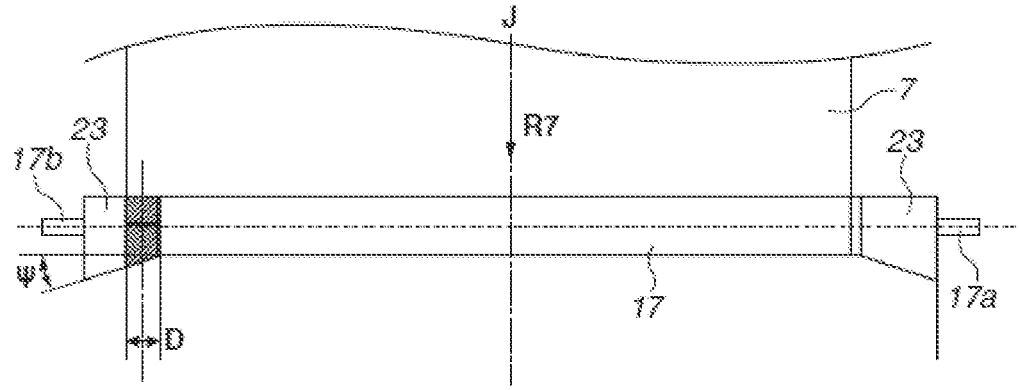
FIG. 5B is a schematic diagram illustrating the operating principle of the automatic belt alignment mechanism in a state where a deviation occurs in the intermediate transfer belt.

The detailed configuration and the operation of the automatic belt alignment mechanism 17U according to the present exemplary embodiment will now be described with reference to FIGS. 4, 5A, and 5B. Each of FIGS. 5A and 5B is a plan view (a top view) from a viewpoint in the direction of an arrow TV in FIGS. 2A and 2B. FIG. 5A illustrates a steady state where forces in the width direction W acting on the intermediate transfer belt 7 are balanced by the operation of the automatic belt alignment mechanism 17U. In other words, the steady state is the state where the winding position of the intermediate transfer belt 7 is a normal position. FIG. 5B illustrates the state where a belt deviation occurs on the left side in FIG. 5B while the intermediate transfer belt 7 is conveyed in the direction of the arrow R7.

As illustrated in FIG. 4, each steering bearing 23 that axially supports the roller shaft 17*b* includes a sliding friction surface 231 that comes into sliding contact with the inner peripheral surface of the intermediate transfer belt 7, thereby generating steering torque. The "steering torque" refers to the moment of a force to change the alignment of the steering roller 17 in the direction in which the deviation of the intermediate transfer belt 7 can be reduced. As described above, the moving direction of the steering bearing 23 is restricted by the slide guide 24 such that the steering bearing 23 moves in the direction of the arrow K1 in FIG. 4. Thus, the steering bearing 23, which is an example of a friction portion, is not driven with the conveyance and driving of the intermediate transfer belt 7 in the direction of the arrow R7, but comes into sliding contact with the inner peripheral surface of the intermediate transfer belt 7.

The sliding friction surface 231 is formed into a tapered shape such that the further outward in the axial direction of the steering roller 17 the sliding friction surface 231 is, the larger the outer diameter of the sliding friction surface 231 gradually becomes. The maximum diameter of the sliding friction surface 231 is larger than the outer diameter of the steering roller 17, which is cylindrical. As illustrated in FIG. 5B, the outer diameter of the steering roller 17 is set to, for example, $\phi$16 (16 mm) in the present exemplary embodiment. The sliding friction surface 231 of the steering bearing 23 includes an outer peripheral portion having the same circumference, i.e., $\phi$16, at a joint portion with the steering roller 17. The sliding friction surface 231 has a curved surface shape such that the diameter of the sliding friction surface 231 gradually becomes larger outward at the rate of a taper angle $\psi$=10° from the outer peripheral portion.

In the present exemplary embodiment, the dimension in the width direction W, i.e., a direction orthogonal to the conveyance driving direction (the direction of the arrow R7), of the intermediate transfer belt 7 is set to partially cover the region of the sliding friction surface 231 having the taper angle $\psi$. In other words, a width Lb of the intermediate transfer belt 7 is set to be longer than the length (Lr) in the axial direction of the roller main body 17*a* of the steering roller 17 and shorter than the width (Lr+2Lf) between both ends of the steering bearings 23 and 23 (Lr<Lb<Lr+2Lf). Lf is the length in the width direction W of the sliding friction surface 231 of each steering bearing 23.

With reference to FIGS. 5A and 5B, a description will be given of the operating principle that the intermediate transfer belt 7 comes into sliding friction with the steering bearings 23, thereby enabling a belt automatic center adjustment. As described above, the steering bearings 23 are supported such that the steering bearings 23 cannot be driven with the intermediate transfer belt 7. Thus, the steering bearings 23 can come into sliding contact with the inner peripheral surface of the intermediate transfer belt 7 when the intermediate transfer belt 7 is conveyed and driven. At this time, frictional forces occur in regions where the intermediate transfer belt 7 is wound around the steering bearings 23, i.e., regions on the right side where the intermediate transfer belt 7 moves downward as viewed from the direction of an arrow G illustrated in FIG. 4. Thus, downward frictional forces act on the steering bearings 23.

As described above, the dimension (Lb) in the width direction W of the intermediate transfer belt 7 is set to cover the tapered sliding friction surfaces 231 of the steering bearings 23. In the steady state (the normal state) illustrated in FIG. 5A, the intermediate transfer belt 7 comes into sliding friction with the sliding friction surfaces 231 of the steering bearings 23 on both sides at equivalent winding widths (e.g., 2 mm). In this state, moments generated by frictional forces acting on the steering bearings 23 on both sides from the intermediate transfer belt 7 cancel out each other.

Specifically, the frictional forces received by the steering bearings 23 from the intermediate transfer belt 7 act on the steering bearings 23 and the swinging plate 26 as moments in opposite directions to each other with respect to the steering axis J. Thus, in the steady state illustrated in FIG. 5A, the frictional forces received by the steering bearings 23 are approximately equal to each other, and the moments cancel out each other, thereby maintaining the orientation of the swinging plate 26. Whereby, the steering roller 17 is held in the orientation in which the axial direction of the steering roller 17 is substantially parallel (the state where the axial directions are aligned with each other) to those of the other roller members, such as the secondary inner transfer roller 8.

In contrast, in the state where a so-called "deviation" occurs, in which the intermediate transfer belt 7 deviates to either one side in the width direction W, the winding width of the intermediate transfer belt 7 on one of the steering bearings 23 is greater than the winding width of the intermediate transfer belt 7 on the other steering bearing 23, as illustrated in FIG. 5B. In the example illustrated in FIG. 5B, the winding width of the intermediate transfer belt 7 on the steering bearing 23 on the left side illustrated in FIG. 5B is D [mm], and the winding width of the intermediate transfer belt 7 on the steering bearing 23 on the right side in FIG. 5B is 0. That is, the intermediate transfer belt 7 is off the sliding friction surfaces 231.

In this case, the magnitude of a force received by one of the steering bearings 23 is F(ST)*D, where F(ST) is a vertically downward frictional force received in the range of a certain winding width of the intermediate transfer belt 7 on each sliding friction surface 231 from the intermediate transfer belt 7. Meanwhile, the winding width of the intermediate transfer belt 7 on the other steering bearing 23 is 0. Thus, the other steering bearing 23 does not substantially receive a force from the intermediate transfer belt 7. In the state illustrated in FIG. 5B, steering torque to move a left end portion of the steering roller 17 downward (to the far side in FIG. 5B) is generated, accordingly.

The steering angle of the steering roller 17 generated based on the foregoing principle, i.e., the angle of inclination of the steering roller 17 in the state where the steering roller 17 is swung according to the steering torque, matches the direction in which the deviation of the intermediate transfer belt 7 is turned back to normal. The deviation of the intermediate transfer belt 7 is then reduced according to the conveyance of the intermediate transfer belt 7. That is, the automatic belt alignment mechanism 17U converts part of a driving force to convey and drive the intermediate transfer belt 7 into steering torque, thereby exerting an automatic alignment effect for controlling the position in the width direction W of the intermediate transfer belt 7.

In the present exemplary embodiment, a configuration is employed in which the taper angle $\psi$ is provided in each steering bearing 23, thereby setting a relatively low coefficient of friction $\mu$S and avoiding an abrupt steering operation. Specifically, a resin material having sliding friction properties (low-friction properties), such as polyacetal (POM), is used as the material of the steering bearing 23, the coefficient of friction $\mu$S is set to about 0.3, and the taper angle $\psi$ is set to approximately 5° to 10°, whereby it is possible to obtain an excellent result. Furthermore, the steering bearing 23 is also made conductive, in view of electrostatic adverse effects due to frictional charging with the intermediate transfer belt 7. A configuration may be employed in which the taper angle iv and the sliding friction properties differ as long as required steering torque can be obtained. For example, the sliding friction surface 231 of the steering bearing 23 may be cylindrical.

[Separation Mechanism of Intermediate Transfer Belt]

Figure 6:
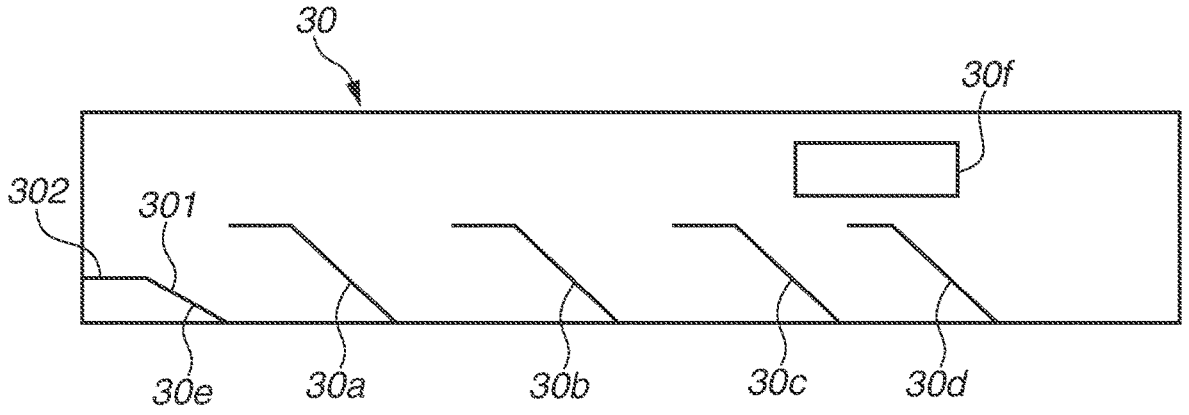
FIG. 6 is a schematic diagram of a separation slider.
Figure 7A:
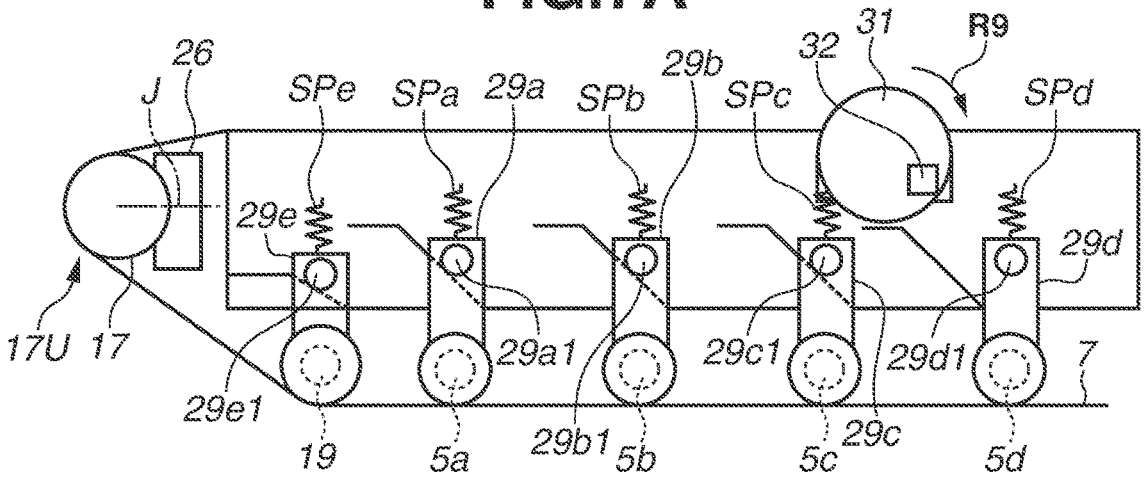
FIG. 7A is a schematic diagram illustrating an operation of a separation mechanism in a color mode.
Figure 7B:
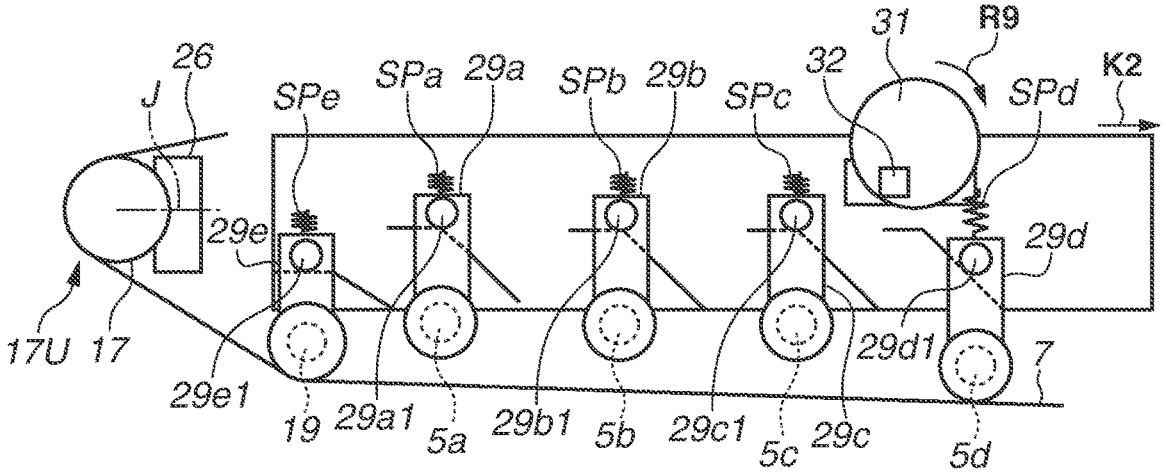
FIG. 7B is a schematic diagram illustrating the operation of the separation mechanism in a monochrome mode.
Figure 7C:
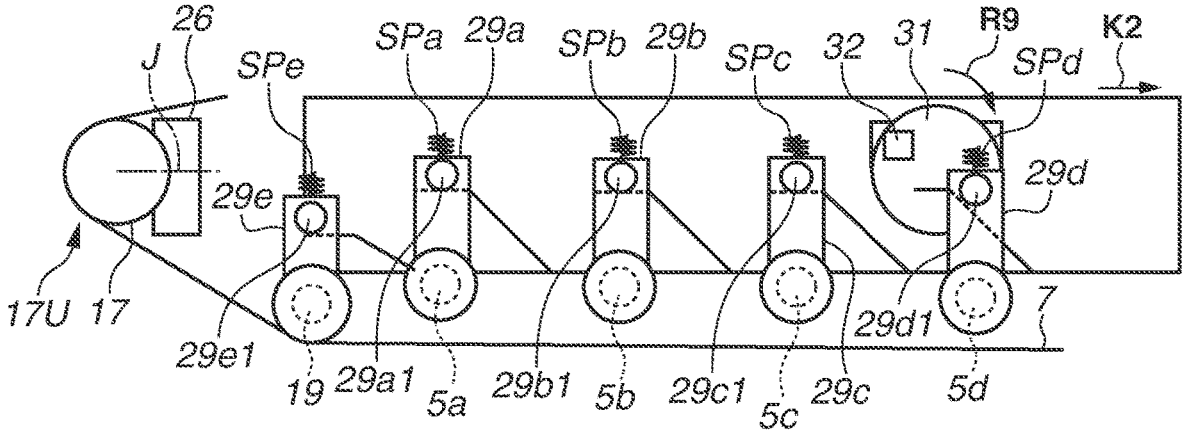
FIG. 7C is a schematic diagram illustrating the operation of the separation mechanism in an all-separation mode.

A description will now be given of the configuration for enabling the separation of the intermediate transfer belt 7 from the photosensitive drums 1*a* to 1*d* with reference to FIGS. 6, 7A, 7B, and 7C. FIG. 6 illustrates the state where a separation slider 30 is viewed from the front side. FIG. 7A schematically illustrates the intermediate transfer unit 20 in a color mode (hereinafter, a "CL mode"). FIG. 7B schematically illustrates the intermediate transfer unit 20 in a monochrome mode (hereinafter, a "BK mode"). FIG. 7C schematically illustrates the intermediate transfer unit 20 in an all-separation mode.

As described above, the primary transfer rollers 5*a* to 5*d* opposed to the photosensitive drums 1*a* to 1*d* of the image forming units Pa to Pd, respectively, are placed on the inner peripheral side of the intermediate transfer belt 7 (see FIG. 1). In the present exemplary embodiment, the primary transfer rollers 5*a* to 5*d* and the separation roller 19, which is located upstream of the primary transfer rollers 5*a* to 5*d*, are movable relative to the frame body of the intermediate transfer unit 20.

The primary transfer rollers 5*a* to 5*d* and the separation roller 19 are moved by performing a slide operation for sliding the separation slider 30 illustrated in FIG. 6. Separation sliders 30 having similar shapes are accommodated within the transfer frame 21 of the intermediate transfer unit 20 (see FIG. 2). Specifically, each separation slider 30 includes four cam surfaces 30*a*, 30*b*, 30*c*, and 30*d* corresponding to the primary transfer rollers 5*a* to 5*d*, respectively, and a cam surface 30*e* corresponding to the separation roller 19. The two separation sliders 30 slide in synchronization with each other relative to the transfer frame 21 such that the moving directions of the separation sliders 30 are the left-right direction in FIG. 6.

Each of the cam surfaces 30*a* to 30*e* includes a sloping surface inclined with respect to the sliding directions of the separation sliders 30, and is formed to achieve the operations of the rollers (5*a* to 5*d* and 19) in the following mode switching. For example, the cam surface 30*e*, which corresponds to the separation roller 19, includes a sloping surface 301 corresponding to a lower position of the separation roller 19, and a flat portion 302 corresponding to an upper position of the separation roller 19.

As illustrated in FIGS. 7A to 7C, both ends in the axial directions of the primary transfer rollers 5*a* to 5*d* are rotatably and axially supported by corresponding primary transfer bearings 29*a* to 29*d*. The primary transfer bearings 29*a* to 29*d* are placed on both sides in the axial directions of the primary transfer rollers 5*a* to 5*d* and supported by the transfer frame 21. All the primary transfer bearings 29*a* to 29*d* are held by the transfer frame 21 in the state where the primary transfer bearings 29*a* to 29*d* are fitted to be movable in the up-down direction in FIGS. 7A to 7C. The movement of the primary transfer bearings 29*a* to 29*d* in a direction along the conveying direction (the arrow R7) of the intermediate transfer belt 7 is then restricted.

The primary transfer bearings 29*a* to 29*d* are provided with abutment portions 29*a*1 to 29*d*1 that abut the cam surfaces 30*a* to 30*d*, respectively, of the separation sliders 30. Between the primary transfer bearings 29*a* to 29*d* and the transfer frame 21, primary transfer springs SPa to SPd are provided to bias the primary transfer bearings 29*a* to 29*d* downward in FIGS. 7A to 7C to press the primary transfer bearings 29*a* to 29*d* against the cam surfaces 30*a* to 30*d*, respectively. In a case where the separation sliders 30 move in a sliding manner, the primary transfer bearings 29*a* to 29*d* move in the up-down direction in FIGS. 7A to 7C in the state where the abutment portions 29*a*1 to 29*d*1 abut the cam surfaces 30*a* to 30*d*, respectively, whereby the primary transfer rollers 5*a* to 5*d* move.

The separation roller 19 also has a movement configuration similar to those of the primary transfer rollers 5*a* to 5*d*. Specifically, both ends in the axial direction of the separation roller 19 are rotatably and axially supported by separation roller bearings 29*e* placed on both sides in the axial direction of the separation roller 19. The separation roller bearings 29*e* are held by the transfer frame 21 in the state where the separation roller bearings 29*e* are movable in the up-down direction in FIGS. 7A to 7C, and the movement of the separation roller bearings 29*e* in a direction along the conveying direction (the arrow R7) of the intermediate transfer belt 7 is restricted. The separation roller bearings 29*e* also include abutment portions 29*e*1 that abut the cam surfaces 30*e* of the separation sliders 30. The separation roller bearings 29*e* are pressed against the cam surfaces 30*e* by separation roller springs SPe. In a case where the separation sliders 30 move in a sliding manner, the separation roller bearings 29*e* move in the up-down direction in FIGS. 7A to 7C in the state where the abutment portions 29*e*1 abut the cam surfaces 30*e*, whereby the separation roller 19 moves.

Each separation slider 30 includes a slide biasing surface 30*f* (see FIG. 6) engaged with a separation cam 31 attached to a separation cam shaft 32. The separation slider 30 is biased in the left-right direction in FIGS. 7A to 7C by the separation cam 31 pressing the slide biasing surface 30*f*. A separation coupling 33 (see FIG. 2) is attached to an end portion in the axial direction of the separation cam shaft 32 in the state where the intermediate transfer unit 20 is attached to the apparatus main body 201. The separation coupling 33 is linked to and driven by a driving source provided in the apparatus main body 201 of the image forming apparatus 200.

The separation sliders 30 correspond to movable members movable in directions intersecting the moving directions (the up-down direction in FIGS. 7A to 7C) of the separation roller bearings 29*e*, which correspond to bearing members according to the present exemplary embodiment. The separation roller springs SPe correspond to biasing methods for biasing the bearing members toward cam surfaces, thereby causing the bearing members to follow the cam surfaces.

In the present exemplary embodiment, the primary transfer rollers 5*a* to 5*d* and the separation roller 19 are moved by a separation mechanism 30A (FIG. 2B) that includes the separation sliders 30 and the separation cams 31 as described above, and thereby switching the modes illustrated in FIGS. 7A to 7C is performed. The following mode switching is achieved by controlling the rotation phase of the separation cam shaft 32 based on a control signal from the CPU 50 (FIG. 1), which is provided in the image forming apparatus 200. Although a description is given using as an example an operation in a case where the modes are switched in the order of the CL mode, the BK mode, and the all-separation mode, the modes can be switched between any modes by tracing the operation backwards.

In the CL mode illustrated in FIG. 7A, the primary transfer rollers 5*a* to 5*d* and the separation roller 19 are all held at lower positions, and the intermediate transfer belt 7 abuts the photosensitive drums 1*a* to 1*d* of the image forming units Pa to Pd, respectively (see FIG. 1). In this state, the image forming units Pa to Pd are caused to execute an image forming operation, and toner images formed on the photosensitive drums 1*a* to 1*d* are transferred to the printing medium S via the intermediate transfer belt 7, whereby it is possible to form a full-color image on the printing medium S.

In a case where the CL mode is switched to the BK mode illustrated in FIG. 7B, the separation cams 31 rotate 90 degrees in the direction of an arrow R9, and the separation sliders 30 slide rightward (an arrow K2) in FIG. 7B. In the BK mode, the primary transfer rollers 5*a*, 5*b*, and 5*c* for cyan, magenta, and yellow, respectively, move to upper positions and separate from the inner peripheral surface of the intermediate transfer belt 7, and the separation roller 19 also moves to the upper position. At this time, the intermediate transfer belt 7 is stretched around the separation roller 19 at the upper position and the primary transfer roller 5*d* for black remaining held at the lower position, and the intermediate transfer belt 7 separates from the photosensitive drums 1*a*, 1*b*, and 1*c* for the colors except for black. In this state, the image forming unit Pd for black is caused to execute an image forming operation, and a toner image formed on the photosensitive drum 1*d* is transferred to the printing medium S via the intermediate transfer belt 7, whereby it is possible to form a monochrome image on the printing medium S.

In a case where the BK mode is switched to the all-separation mode illustrated in FIG. 7C, the separation cams 31 rotate 90 more degrees in the direction of the arrow R9, and the separation sliders 30 slide rightward (the arrow K2) in FIG. 7C. In the all-separation mode, all the primary transfer rollers 5*a* to 5*d* move to upper positions and separate from the inner peripheral surface of the intermediate transfer belt 7, and the separation roller 19 remains at the upper position. At this time, the intermediate transfer belt 7 is stretched around the separation roller 19 at the upper position and the upstream guide roller 18 (see FIG. 1), and the intermediate transfer belt 7 separates from all the photosensitive drums 1*a* to 1*d*. The intermediate transfer unit 20 is controlled to be in the all-separation mode in a case where the work of replacing the intermediate transfer belt 7 is performed, and also in a case where, for example, the image forming apparatus 200 is waiting for a signal (a print job) giving an instruction to start an image forming operation.

The separation roller 19 described above is an example of a roller member around which the intermediate transfer belt 7 is stretched. The lower position (FIG. 7A) corresponds to a first position, and the upper position (FIG. 7C) corresponds to a second position where the roller member is moved further inward on the inner peripheral side of the intermediate transfer belt 7 than the first position. The separation mechanism 30A (FIG. 2B) is an example of a movement mechanism for moving such a roller member to the first and second positions. The CL mode corresponds to a first state where the intermediate transfer belt 7 abuts the image bearing members. The all-separation mode corresponds to a second state where the intermediate transfer belt 7 separates from the image bearing members. The BK mode corresponds to a third state where the intermediate transfer belt 7 abuts some of the image bearing members and separates from the other image bearing members, in a configuration including a plurality of image bearing members.

[Configurations for Attaching/Detaching and Positioning Intermediate Transfer Unit]

A description is now given of the configuration for attaching and detaching the intermediate transfer unit 20 to and from the apparatus main body 201 when the intermediate transfer belt 7 is replaced.

Figure 8:
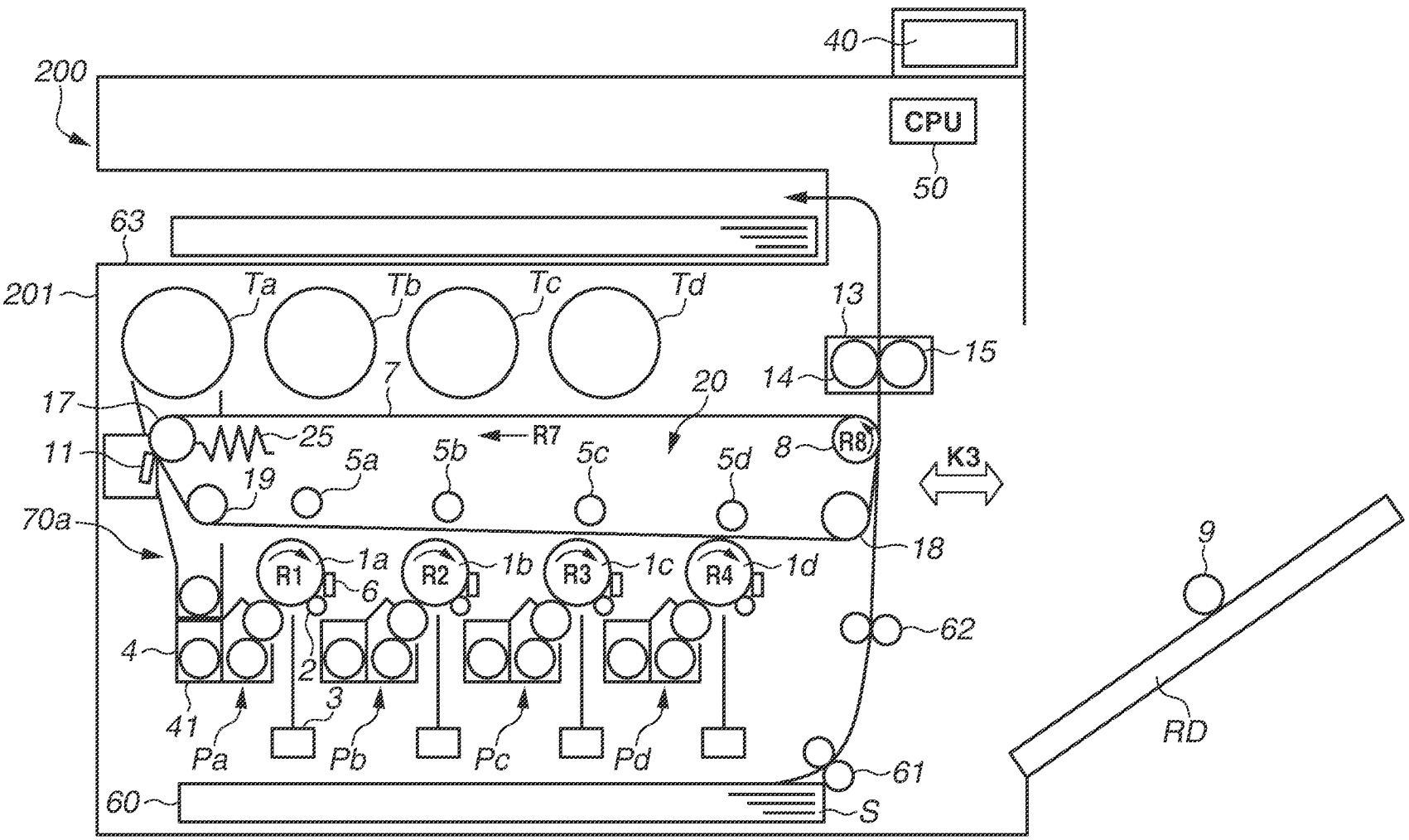
FIG. 8 is a schematic diagram illustrating a configuration for attaching and detaching the intermediate transfer unit to and from an apparatus main body.

As illustrated in FIG. 8, the intermediate transfer unit 20 is attachable to and detachable from the apparatus main body 201 of the image forming apparatus 200 in the state where the intermediate transfer unit 20 is held in the all-separation mode. Specifically, the intermediate transfer unit 20 is exposed by opening a right door RD provided on the right side as viewed from the front of the apparatus main body 201. The intermediate transfer unit 20 can then be attached to and detached from the apparatus main body 201 by moving the intermediate transfer unit 20 in the left-right direction (an arrow K3). In other words, the intermediate transfer unit 20 is provided to be attachable to and detachable from the apparatus main body 201 in a left-right direction intersecting both the width direction W of the intermediate transfer belt 7 and the vertical direction. The intermediate transfer unit 20 can also be configured to be attached to and detached from the apparatus main body 201 in the front-back direction in FIG. 8. However, the above attachment/detachment direction is employed in view of positioning accuracy relative to the image forming units Pa to Pd and a necessity of a housing that covers the intermediate transfer unit 20.

Figure 9A:
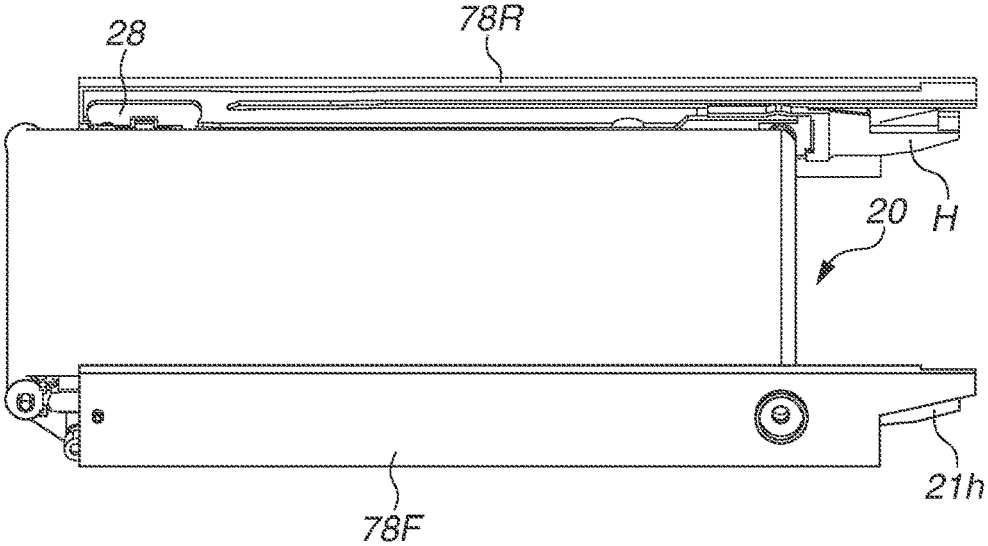
FIG. 9A is a perspective view illustrating an operation of attaching and detaching the intermediate transfer unit in an attached state where the intermediate transfer unit is attached to the apparatus main body.
Figure 9B:
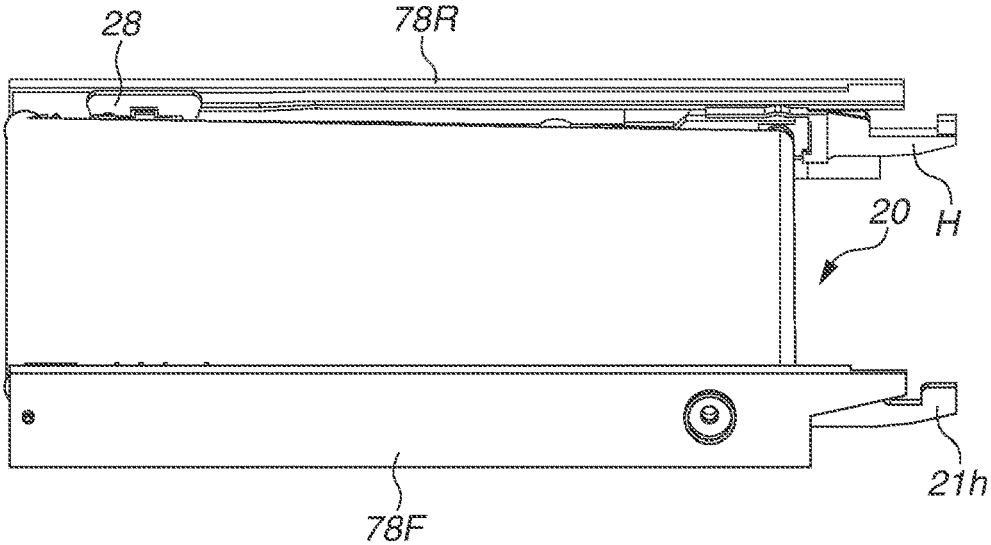
FIG. 9B is a perspective view illustrating the operation of attaching and detaching the intermediate transfer unit in a middle of an attachment/detachment state.
Figure 9C:
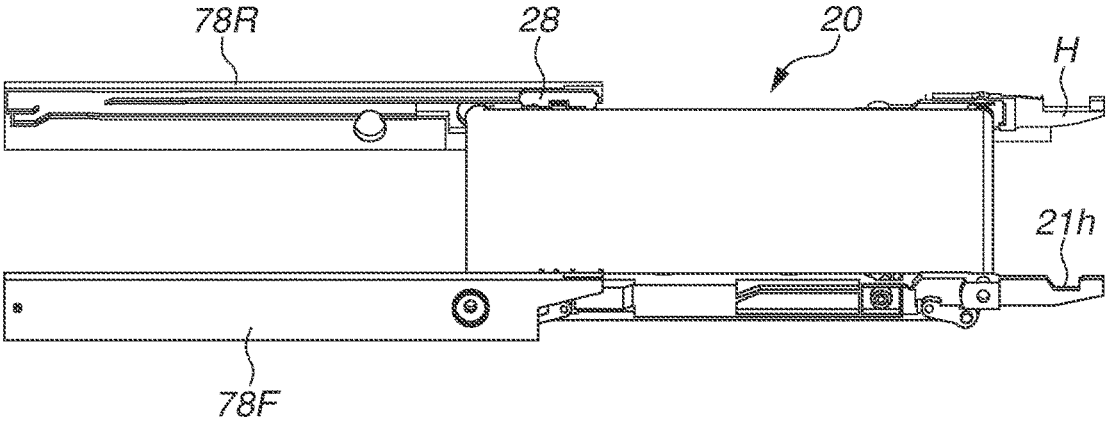
FIG. 9C is a perspective view illustrating the operation of attaching and detaching the intermediate transfer unit in a pulled-out state.
Figure 10A:
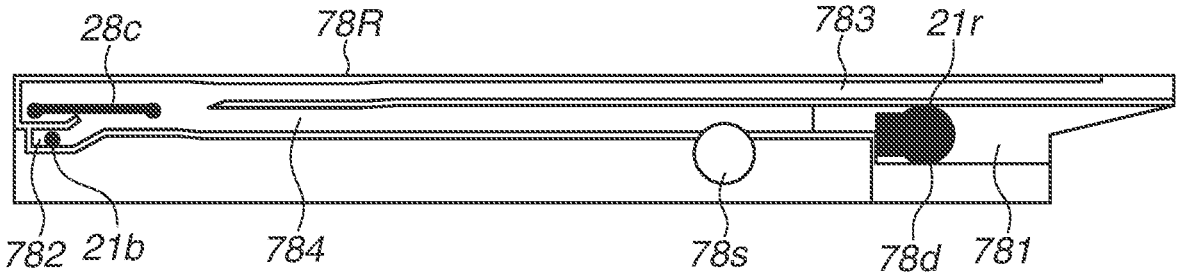
FIG. 10A is a cross-sectional view illustrating the operation of attaching and detaching the intermediate transfer unit in the attached state where the intermediate transfer unit is attached to the apparatus main body.
Figure 10B:
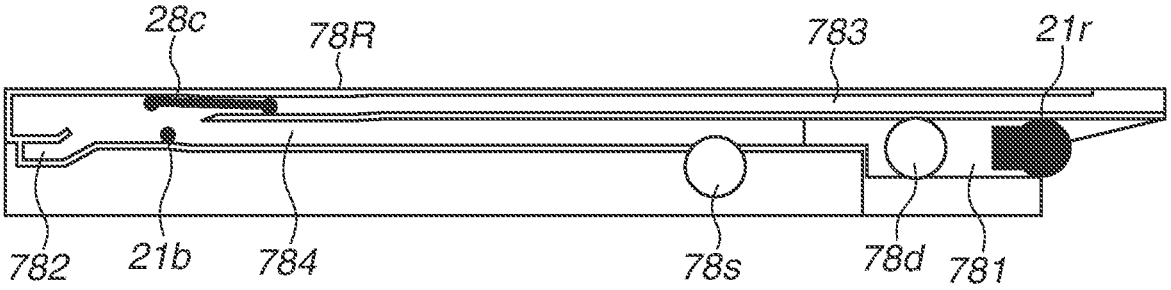
FIG. 10B is a cross-sectional view illustrating the operation of attaching and detaching the intermediate transfer unit in the attachment/detachment middle state.
Figure 10C:
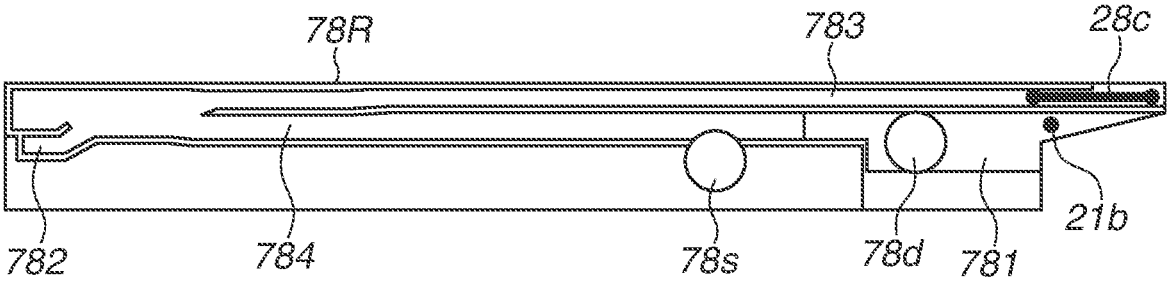
FIG. 10C is a cross-sectional view illustrating the operation of attaching and detaching the intermediate transfer unit in the pulled-out state.

A detailed description is now given with reference to FIGS. 9A, 9B, 9C, 10A, 10B, 10C, and 11. FIGS. 9A, 9B, and 9C are perspective views illustrating the operation of attaching and detaching the intermediate transfer unit 20. The upper side in FIGS. 9A, 9B, and 9C is the back surface side of the apparatus main body 201, and the lower side thereof is the front surface side of the apparatus main body 201. FIG. 9A illustrates the state where the intermediate transfer unit 20 is attached to the apparatus main body 201 (hereinafter, an "attached state"). FIG. 9B illustrates the state where the intermediate transfer unit 20 is in the middle of being attached to the apparatus main body 201 (hereinafter, an "attachment/detachment middle state"). FIG. 9C illustrates the state where the intermediate transfer unit 20 is pulled out of and detachable from the apparatus main body 201 (hereinafter, a "pulled-out state"). FIGS. 10A, 10B, and 10C are cross-sectional views illustrating the operation of attaching and detaching the intermediate transfer unit 20 and cross sections on the back surface side of the apparatus main body 201. FIGS. 10A, 10B, and 10C illustrate the attachment/detachment states of the intermediate transfer unit 20 by corresponding to FIGS. 9A, 9B, and 9C, respectively. FIGS. 10A, 10B, and 10C illustrate the attached state, the attachment/detachment middle state, and the pulled-out state, respectively.

The transfer rails 78F and 78R are placed on the inner surface of the apparatus main body 201 and formed into symmetrical shapes except for the difference between partial shapes. The partial shapes include a transmission driving hole 78*d* and a separation driving hole 78*s* illustrated in FIGS. 10A, 10B, and 10C. The transmission driving hole 78*d* is a hole for transmitting drive from a driving source of the apparatus main body 201 to the drive coupling 22 provided in the intermediate transfer unit 20. The separation driving hole 78*s* is a hole for transmitting drive from a driving source of the apparatus main body 201 to the separation coupling 33 provided in the intermediate transfer unit 20. Each of the transmission driving hole 78*d* and the separation driving hole 78*s* includes a linking member protruding to link and drive each other (not illustrated). The transfer rails 78F and 78R have symmetrical shapes except for the difference between the partial shapes and therefore are described below using the configuration of the transfer rail 78R as an example.

In the transfer rail 78R, guide portions for attaching and detaching the intermediate transfer unit 20 are provided. A first guide portion 781 includes a first fitting portion to which the first positioning portion 21*r* provided in the transfer frame 21 is movably fitted. A second guide portion 782 includes a second fitting portion to which the second positioning portion 21*b* provided in the transfer frame 21 is movably fitted. A third guide portion 783 is configured such that the third positioning portion 28*c* is movably engaged with the third guide portion 783. The first guide portion 781 is provided on the upstream side in the attachment direction of the intermediate transfer unit 20, and the second guide portion 782 is provided on the downstream side in the attachment direction of the intermediate transfer unit 20. In the present exemplary embodiment, the first guide portion 781 and the second guide portion 782 are formed of a common guide rail, and the second positioning portion 21*b* is configured to pass through the first guide portion 781 when the intermediate transfer unit 20 is attached or detached.

The positioning portions of the intermediate transfer unit 20 have been described above in the section titled [Intermediate Transfer Unit].

In the attached state (FIGS. 9A and 10A), the first positioning portion 21*r* is fitted to the first guide portion 781, and the second positioning portion 21*b* is fitted to the second guide portion 782, and thereby the intermediate transfer unit 20 is positioned relative to the image forming units Pa to Pd. As a result of this, an image can be formed in the CL mode and the BK mode of the separation mechanism 30A (FIG. 2B) described above.

In the all-separation mode, a person performing replacement work moves the intermediate transfer unit 20 in the direction of the arrow K3 in FIG. 8 while holding a frame holding portion 21*h* and a handle member H, whereby the all-separation mode shifts to the attachment/detachment middle state (FIGS. 9B and 10B). In the attachment/detachment middle state, the first positioning portion 21*r* is movably fitted to the first guide portion 781, and the third positioning portion 28*c* is movably engaged with the third guide portion 783. The third positioning portion 28*c* is composed of two cylindrical portions and a horizontal portion connecting the two cylindrical portions.

If the intermediate transfer unit 20 is slightly pulled out from the attachment/detachment middle state, the first positioning portion 21*r* comes out of the first guide portion 781 (the fitting relationship is released). At this time, if the person releases the frame holding portion 21*h* and the handle member H, a clockwise moment occurs in the third positioning portion 28*c* by the weight of the intermediate transfer unit 20 itself. In other words, the frame holding portion 21*h* and the handle member H begin to fall vertically downward. The third positioning portion 28*c* and the third guide portion 783, however, are movably engaged with each other, whereby the intermediate transfer unit 20 is held. The holding (fall prevention) of the intermediate transfer unit 20 by the transfer rails 78F and 78R continues until the pulled-out state (FIGS. 9C and 10C). At this time, the second positioning portion 21*b* passes through a fourth guide portion 784, but is configured not to come into physical contact with the fourth guide portion 784.

If the above-described function of the third positioning portion 28*c* is transferred to the second positioning portion 21*b* by changing the shape of the second positioning portion 21*b*, the driving/linking members penetrating the transmission driving hole 78*d* and the separation driving hole 78*s* protrude into the path of the second positioning portion 21*b*. It is thus difficult to ensure the ease of the attachment and detachment of the intermediate transfer unit 20. Particularly, the second positioning portion 21*b* enters the first guide portion 781 after passing through the fourth guide portion 784. Thus, the second positioning portion 21*b* cannot be engaged, and the intermediate transfer unit 20 may fall before reaching the pulled-out state.

As a result of the above, it is possible to prevent the intermediate transfer unit 20 from falling when the intermediate transfer unit 20 is attached or detached, and also prevent the breakage of the intermediate transfer belt 7 due to contact with another member. After the intermediate transfer unit 20 is moved to the pulled-out state, the intermediate transfer unit 20 becomes detachable from the apparatus main body 201. The procedure for attaching the intermediate transfer unit 20 to the apparatus main body 201 is achieved by reversing the procedure described above.

[Attachment and Detachment of Intermediate Transfer Belt]

Figure 11:
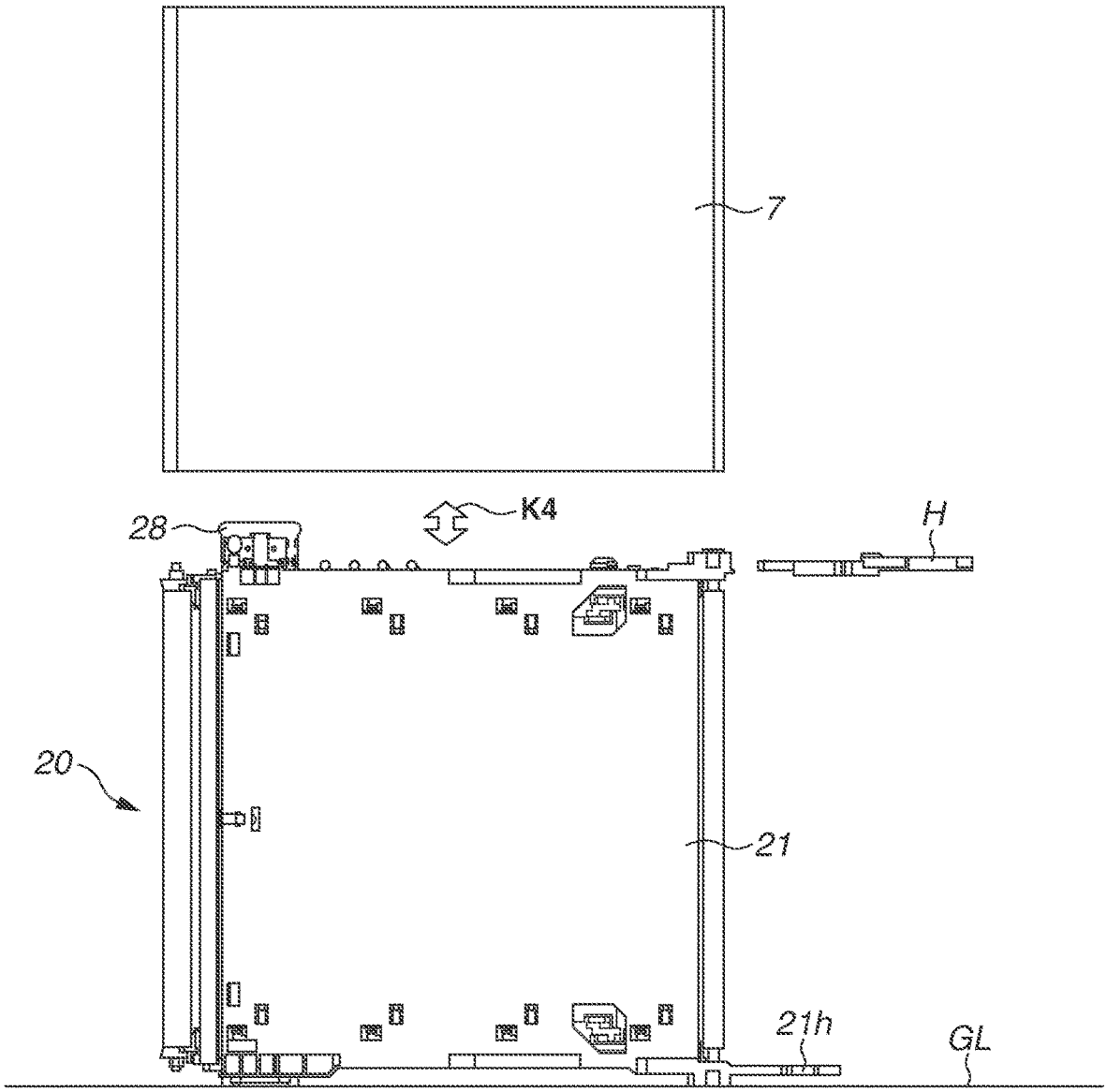
FIG. 11 is a schematic diagram illustrating work of replacing the intermediate transfer belt.

When replacing the intermediate transfer belt 7, it is desirable that the intermediate transfer unit 20 is placed such that the transfer frame 21 contacts a worktable GL, and the frame holding portion 21*h* provided in the transfer frame 21 is located vertically below the transfer frame 21, as illustrated in FIG. 11. A configuration may be employed in which the intermediate transfer unit 20 stands alone. The person performing replacement work may then replace the intermediate transfer belt 7 with one hand while holding the transfer frame 21.

After the intermediate transfer unit 20 is stood upright, the following cases may be employed: a case where the intermediate transfer belt 7 is detached after the steering roller 17 is detached, and a case where the intermediate transfer belt 7 is detached by releasing the tension of the intermediate transfer belt 7 with the steering roller 17 remaining attached. The present exemplary embodiment may employ either configuration.

Figure 12A:
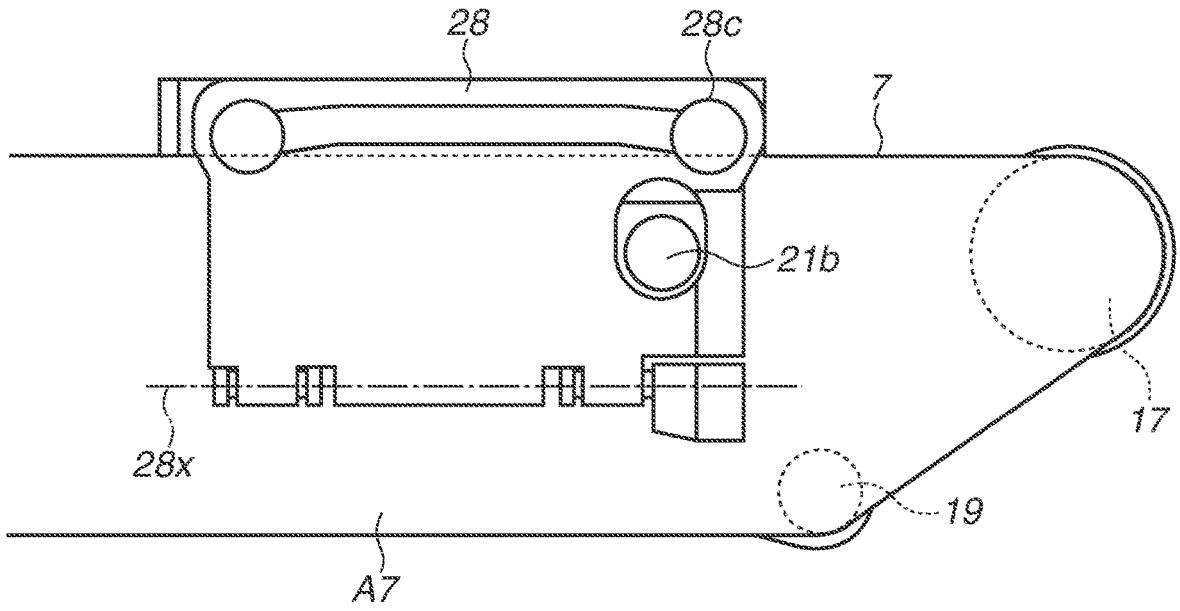
FIGS. 12A and 12B are schematic diagrams illustrating a movable range of a positioning plate (a third positioning portion).
Figure 12B:
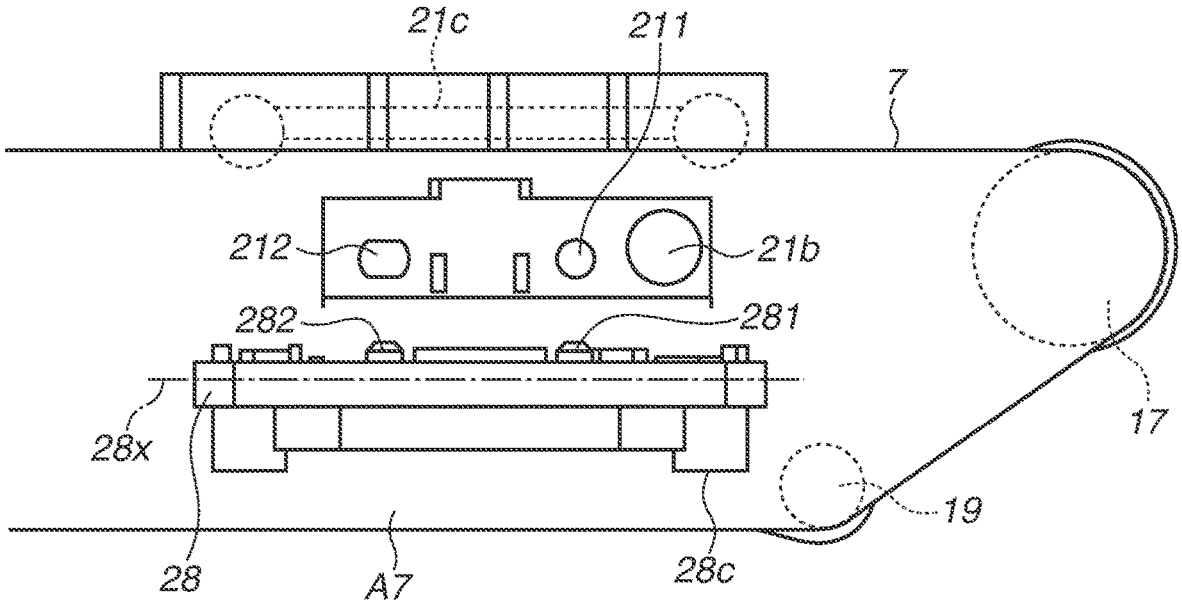

The positioning plate 28 is then moved as illustrated in FIGS. 12A and 12B. FIG. 12A illustrates the state after the intermediate transfer unit 20 is detached from the apparatus main body 201 (also including the pulled-out state where the intermediate transfer unit 20 is pulled out of the apparatus main body 201). FIG. 12B illustrates the state in which the intermediate transfer belt 7 is in a replaceable state. In the state of FIG. 12A, parts of the positioning plate 28 and the third positioning portion 28*c* are located outside a projection plane (projection area) A7 around which the intermediate transfer belt 7 is stretched (a first state). That is, the positioning plate 28 is placed above the projection area A7 obtained by projecting, in the width direction W of the intermediate transfer belt 7, a stretching area around which the intermediate transfer belt 7 is stretched. In this case, the intermediate transfer belt 7 and the positioning plate 28 interfere with each other in the moving path of the intermediate transfer belt 7 and the intermediate transfer belt 7 cannot be detached, even if an attempt is made to move the intermediate transfer belt 7 in the direction of an arrow K4 in FIG. 11. For this reason, a configuration for enabling the movement of the positioning plate 28 is provided.

The positioning plate 28 is rotationally moved 90° in the near direction in FIGS. 12A and 12B about a rotational axis 28*x* in FIGS. 12A and 12B, whereby the state illustrated in FIG. 12A shifts to the state illustrated in FIG. 12B. By performing this operation, the entirety of the positioning plate 28 and the third positioning portion 28*c* is located inside the projection plane A7 around which the intermediate transfer belt 7 is stretched (a second state), and the intermediate transfer belt 7 can be moved in the direction of the arrow K4 in FIG. 11.

In this configuration, the intermediate transfer unit 20 is positioned by the second positioning portion 21*b* in the installed state of the intermediate transfer unit 20 as described above. The intermediate transfer unit 20 may be positioned by the third positioning portion 28*c*. The third positioning portion 28*c*, however, positions the intermediate transfer unit 20 relative to the transfer frame 21 by fitting two projections 281 and 282 provided in the positioning plate 28 to holes 211 and 212 provided in the transfer frame 21. Thus, the intermediate transfer unit 20 is positioned by the second positioning portion 21*b* in the installed state in view of unit stiffness and positioning accuracy related to image formation.

Finally, the handle member H held when the attachment/detachment operation is performed is detached from the transfer frame 21, whereby the intermediate transfer belt 7 can be detached and attached again by moving the intermediate transfer belt 7 in the up-down direction (the width direction W of the intermediate transfer belt 7, the arrow K4).

With these configurations, it is possible to ensure the ease of the attachment and detachment of the intermediate transfer unit 20, and thereby it is possible to easily replace the intermediate transfer belt 7. Furthermore, the avoidance of contact with drive input portions (driving/linking members) when the intermediate transfer unit 20 is attached and detached, which is an issue in a case where downsizing is performed, can also be achieved without the need to separately provide a mechanism for retracting the driving/linking members.

In the present exemplary embodiment, a configuration is employed in which the positioning plate 28 is supported to be movable relative to the transfer frame 21. Alternatively, the positioning plate 28 may be provided to be attachable to and detachable from the transfer frame 21.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-117361, filed Jul. 7, 2020, which is hereby incorporated by reference herein in its entirety.

What is claimed is:

1. An image forming apparatus comprising:

an image bearing member configured to bear a toner image;

an image forming unit configured to form the toner image on the image bearing member;

a belt conveying device including an intermediate transfer belt to which the toner image formed on the image bearing member is to be transferred, wherein the belt conveying device is provided to be attachable to and detachable from the image forming apparatus in a direction intersecting a width direction of the intermediate transfer belt orthogonal to a moving direction of the intermediate transfer belt and intersecting a vertical direction;

a pair of restriction portions provided in the belt conveying device and configured to restrict an orientation of the intermediate transfer belt; and restriction engagement portions provided in a main body of the image forming apparatus and configured to restrict the orientation of the intermediate transfer belt by being engaged with the pair of restriction portions at least in a case where the belt conveying device is pulled out to a predetermined position in the image forming apparatus, wherein one restriction portion of the pair of restriction portions is supported to be movable to a first position where at least a part of the one restriction portion is placed outside a stretching area defined by the intermediate transfer belt in a stretched state, as viewed from the width direction of the intermediate transfer belt, and a second position where the one restriction portion is inside the stretching area as viewed from the width direction of the intermediate transfer belt.

2. The image forming apparatus according to claim 1, further comprising:

a pair of upstream positioning portions provided in the belt conveying device and configured to position a position in an up-down direction of the belt conveying device on an upstream side in an attachment direction of the belt conveying device; and upstream guide portions provided in the main body of the image forming apparatus and configured to position the pair of upstream positioning portions by being engaged with the pair of upstream positioning portions and to guide the pair of upstream positioning portions, wherein, in a case where the belt conveying device is pulled out, the pair of restriction portions is engaged with the restriction engagement portions before the engagement between the upstream guide portions and the pair of upstream positioning portions is released.

3. The image forming apparatus according to claim 2, further comprising:

a pair of downstream positioning portions provided in the belt conveying device and configured to position the position in the up-down direction of the belt conveying device on a downstream side in the attachment direction of the belt conveying device; and downstream guide portions provided in the main body of the image forming apparatus and configured to position the pair of downstream positioning portions by being engaged with the pair of downstream positioning portions and to guide the pair of downstream positioning portions.

4. The image forming apparatus according to claim 3, further comprising a frame provided in the belt conveying device and configured to rotatably support a stretching roller stretching the intermediate transfer belt, wherein the pair of upstream positioning portions and the pair of downstream positioning portions are fixed to the frame such that the pair of upstream positioning portions and the pair of downstream positioning portions cannot move relative to the frame.

5. The image forming apparatus according to claim 4, wherein the pair of downstream positioning portions pass through the upstream guide portions when the belt conveying device is attached to and detached from the image forming apparatus.

6. The image forming apparatus according to claim 5, further comprising a coupling, wherein the stretching roller is a driving roller configured to drive the intermediate transfer belt, wherein the coupling is provided in an end portion in an axial direction of the driving roller and configured to input drive to the driving roller, and wherein the pair of upstream positioning portions are placed around an outer peripheral portion of the coupling.

7. The image forming apparatus according to claim 6, wherein an up-down width of each of the pair of upstream positioning portions is greater than an up-down width of each of the pair of downstream positioning portions.

8. The image forming apparatus according to claim 1, wherein the pair of restriction portions is located at the second position in a case where the intermediate transfer belt is attached to the belt conveying device.

9. An image forming apparatus comprising:

an image bearing member configured to bear a toner image;

an image forming unit configured to form the toner image on the image bearing member;

a belt conveying device including an intermediate transfer belt to which the toner image formed on the image bearing member is to be transferred, wherein the belt conveying device is provided to be attachable to and detachable from the image forming apparatus in a direction intersecting a width direction of the intermediate transfer belt orthogonal to a moving direction of the intermediate transfer belt and intersecting a vertical direction;

a pair of restriction portions provided in the belt conveying device and configured to restrict an orientation of the intermediate transfer belt; and restriction engagement portions provided in a main body of the image forming apparatus and configured to restrict the orientation of the intermediate transfer belt by being engaged with the pair of restriction portions at least in a case where the belt conveying device is pulled out to a predetermined position in the image forming apparatus, wherein at least a part of one restriction portion of the pair of restriction portions is placed outside a stretching area defined by the intermediate transfer belt in a stretched state, as viewed from the width direction of the intermediate transfer belt, and the one restriction portion is provided to be attachable to and detachable from the belt conveying device.

10. The image forming apparatus according to claim 9, further comprising:

a pair of upstream positioning portions provided in the belt conveying device and configured to position a position in an up-down direction of the belt conveying device on an upstream side in an attachment direction of the belt conveying device; and upstream guide portions provided in the main body of the image forming apparatus and configured to position the pair of upstream positioning portions by being engaged with the pair of upstream positioning portions and to guide the pair of upstream positioning portions, wherein, in a case where the belt conveying device is pulled out, the pair of restriction portions is engaged with the restriction engagement portions before the engagement between the upstream guide portions and the pair of upstream positioning portions is released.

11. The image forming apparatus according to claim 10, further comprising:

a pair of downstream positioning portions provided in the belt conveying device and configured to position the position in the up-down direction of the belt conveying device on a downstream side in the attachment direction of the belt conveying device; and downstream guide portions provided in the main body of the image forming apparatus and configured to position the pair of downstream positioning portions by being engaged with the pair of downstream positioning portions and to guide the pair of downstream positioning portions.

12. The image forming apparatus according to claim 11, further comprising a frame provided in the belt conveying device and configured to rotatably support a stretching roller stretching the intermediate transfer belt, wherein the pair of upstream positioning portions and the pair of downstream positioning portions are fixed to the frame such that the pair of upstream positioning portions and the pair of downstream positioning portions cannot move relative to the frame.

13. The image forming apparatus according to claim 12, wherein the pair of downstream positioning portions pass through the upstream guide portions when the belt conveying device is attached to and detached from the image forming apparatus.

14. The image forming apparatus according to claim 13, further comprising a coupling, wherein the stretching roller is a driving roller configured to drive the intermediate transfer belt, wherein the coupling is provided in an end portion in an axial direction of the driving roller and configured to input drive to the driving roller, and wherein the pair of upstream positioning portions are placed around an outer peripheral portion of the coupling.

15. The image forming apparatus according to claim 14, wherein an up-down width of each of the pair of upstream positioning portions is greater than an up-down width of each of the pair of downstream positioning portions.

16. The image forming apparatus according to claim 15, wherein the pair of restriction portions is detached from the belt conveying device in a case where the intermediate transfer belt is attached to the belt conveying device.

* * * * *